United States Patent [19]

Kopse et al.

[11] 4,171,099

[45] Oct. 16, 1979

[54] FUEL INJECTION NOZZLE FOR INTERNAL COMBUSTION ENGINES

[75] Inventors: Odon Kopse, Stuttgart; Richard Kinzel, Ditzingen; Ewald Eblen, Stuttgart; Willi Voit, Stuttgart; Gregor Schuster, Stuttgart; Franz Eheim, Stuttgart, all of Fed. Rep. of Germany

[73] Assignee: Robert Bosch GmbH, Stuttgart, Fed. Rep. of Germany

[21] Appl. No.: 751,247

[22] Filed: Dec. 16, 1976

[30] Foreign Application Priority Data

Dec. 24, 1975 [DE] Fed. Rep. of Germany ..... 2558790

[51] Int. Cl.[2] ..... F02M 47/02

[52] U.S. Cl. ..... 239/533.8

[58] Field of Search ..... 239/533.3–533.12, 239/533.15, 88, 90–94, 95

[56] References Cited

U.S. PATENT DOCUMENTS

| | | | |
|---|---|---|---|
| 2,408,288 | 9/1946 | Bremser | 239/95 X |
| 3,610,529 | 10/1971 | Huber | 239/533.8 X |

*Primary Examiner*—Robert B. Reeves
*Assistant Examiner*—Andres Kashnikow
*Attorney, Agent, or Firm*—Edwin E. Greigg

[57] ABSTRACT

Improvements in a fuel injection nozzle for internal combustion engines having a needle valve positioned in a chamber constrained by a closure spring positioned in another chamber thereabove, there also being provided an intermediate piston which includes a portion that extends into the spring chamber therebeneath and further includes a working surface area that is subjected to pressures in still another chamber positioned thereabove.

21 Claims, 8 Drawing Figures

65
66
67
68
69
70
71
72
73
74
75
76
77
79
80
82
83
84
85
86
87
88
89
90
91
93
95
96
97
98
36
37
38
P
V

FUEL INJECTION NOZZLE FOR INTERNAL COMBUSTION ENGINES

BACKGROUND OF THE INVENTION

The invention pertains to a fuel injection nozzle for internal combustion engines, having a needle valve which opens toward the inside and which is constrained by a closure spring disposed within a spring chamber positioned thereabove and further includes an axially displaceable and closely fitting intermediate piston which includes a portion that extends into the spring chamber at the side remote from the needle valve and cooperates with the needle valve at least some of the time.

In a known fuel injection nozzle, the intermediate piston acts upon the needle valve during the entire fuel injection operation, and thereby influences the entire fuel injection process. The intermediate piston in such devices is influenced, on the side remote from the needle valve, by a fuel pressure which varies in accordance with the pressure of the fuel delivered to the nozzle for the fuel injection operation. Accordingly, with such devices it is known that the pressure upon this intermediate piston also decreases toward the end of the fuel injection supply operation as the delivery pressure decreases, and further that by decreasing the force of the intermediate piston which acts in the direction of closure of the needle valve will result in a protraction of the fuel injection termination and, accordingly, corresponding deterioration of the exhaust gas valve.

OBJECT AND SUMMARY OF THE INVENTION

Accordingly, the principal object of this invention is to develop an improved fuel injection nozzle of the aforementioned type, by means of which a protraction of the fuel injection termination can be avoided.

A further object of this invention is to increase, in a controlled manner, the forces which act on the intermediate piston in the direction of closure of the needle valve. Thus, with this improved construction practically no amounts or only extremely insignificant amounts, of the internal combustion gases produced by the engine cylinders can penetrate into the injection nozzle, and only then in engines with high compression pressures, such as, for example engines under load.

In the prior art devices, when the intermediate piston acts continuously upon the needle valve, as is the case in the known fuel injection nozzle, the forces in question consist of a hydraulic spring which acts upon the needle valve in addition to the mechanical closure spring, the force of which hydraulic spring is known to vary during the fuel injection process. Since the sum of these closure forces must not exceed a predetermined limit in relation to the fuel injection pressure, and since, on the other hand, the closure pressure should, subsequent to the termination of the fuel injection operation, be as large as possible, a clearance at least equal in size to the opening stroke of the valve, according to one embodiment of the invention, is provided between the needle valve and the intermediate piston, so that during the opening stroke essentially only the closure spring will act upon the needle valve in the direction of closure.

The invention will be better understood as well as other objects and advantages thereof will become more apparent from the following detailed description of the invention taken in conjunction with the drawing.

DESCRIPTION OF THE PREFERRED EMBODIMENTS

Figure 1:
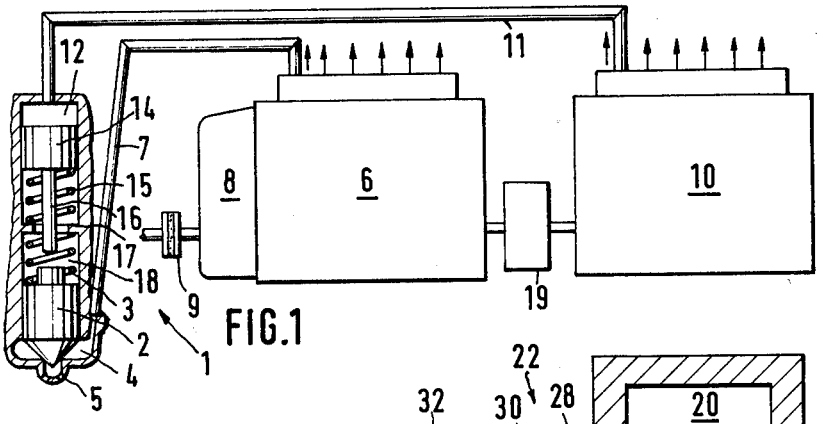
FIG. 1 shows a schematic view of one form of the nozzle in a system which includes plural fuel injection pumps.

Turning now to FIG. 1, this view shows a fuel injection system with two pumps which supply fuel to six fuel injection nozzles of which, however, only one fuel injection nozzle is generally depicted at 1. A needle valve 2, guided in a close fitting housing not further shown, is acted upon by a closure spring 3. The needle valve 2 controls the communication between a pressure chamber 4 and the fuel injection openings 5 in the cylinder wall 4*a*. The fuel is delivered to the pressure chamber 4 by an injection pump 6 by means of a pressure line 7, the construction being such that the needle valve 2 is displaced in opposition to the spring 3 whenever the pressure is sufficient, so that fuel injection can take place by means of the openings 5. The fuel injection pump 6 includes a regulator 8 by means of which the fuel quantity to be injected is determined in the usual manner.

The reference herein to an "intermediate" piston and its operation will be better understood as the description progresses.

The fuel injection pump 6 is driven by the internal combustion engine by means of a coupling 9, and in turn drives the fuel injection pump 10, each of whose pressure outlets is connected to a fuel injection nozzle 1 by means of the lines 11. The fuel delivered via the line 11 reaches a chamber 12 located within the fuel injection nozzle 1, and there contacts an intermediate piston 14. Upon exertion of sufficient pressure, this intermediate piston 14 is displaced in opposition to a restoring spring 15, and, after traversing a predetermined distance, pushes against the needle valve 2 with a shaft 16. An annular collar 17 is affixed to the inner wall of the housing of the spring chamber 18 and its opposite surfaces provide a support for the springs 3 and 15 as shown.

The fuel injection pumps 6 and 10 are coupled to each other in such a manner that the operation by the pump 10 begins once the pump 6 has almost or else fully completed its own operative stroke. By this means, the intermediate piston 14 begins to act upon the needle valve 2 once the needle valve 2 moves toward the closure direction or once it is already in its closure position. Since, as is commonly known, the pressure operations of the fuel injection pump 6 vary with the revolutions per unit time, whereby the dynamic behavior of the opening and the closing of the needle valve 2 is also varied, an injection time point adjuster 19 is provided between pumps 6 and 10 for the propulsion of the pump 10 and for the corresponding accommodation of the closure force produced by the piston 14.

This exemplary embodiment, depicted in FIG. 1, does, however, require two independent lines 7 and 11 solely for the fuel injection operation and for the closure force amplification.

Figure 3:
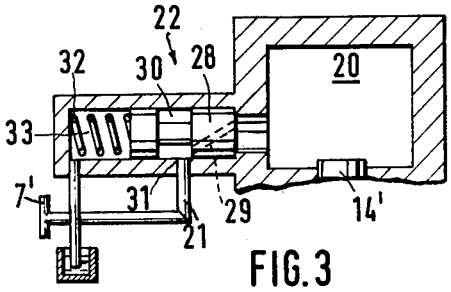
FIG. 3 is a schematic partial view of a pressure equalizing valve.
Figure 2:
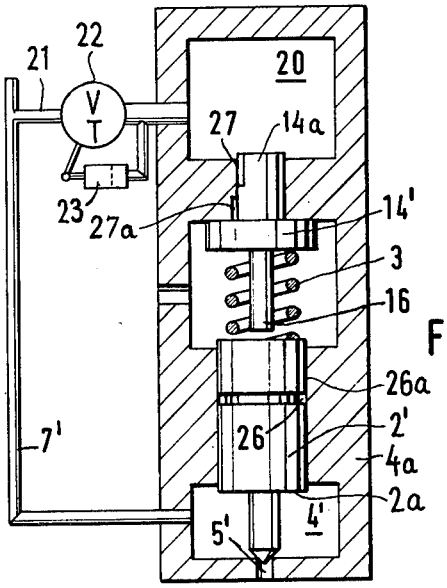
FIG. 2 is another embodiment of another nozzle that includes a pressure equalizing valve.

In the exemplary embodiment depicted in FIGS. 2 and 3, one side of the closure spring 3 engages the needle valve 2' and on the other side thereof engages the intermediate piston 14'. A movement by the intermediate piston 14' in the direction toward the needle valve thus results in an amplification of the force of the closure spring 3, even before the intermediate piston 14' acts directly upon the needle valve 2' via the shaft 16. As shown, the intermediate piston 14' includes an upstanding head portion 14*a* which projects into a reservoir chamber 20 which is placed under the influence of pressure from the pressure line 7' via a line 21. A throttle valve or a pressure equalizing valve 22 is located in the fuel line 21. The head portion 14*a* of the intermediate piston 14' which causes it to move in the direction of the needle valve is smaller than, or equal to, the surface 2*a* of the needle valve 2' that is exposed to the pressure in chamber 4' when the valve is subjected to upward pressure to cause it to open. The surface 2*a* which lifts the needle valve 2' into an open direction is augmented by the area of the valve seat subsequent to the lifting of the needle valve 2'. In view of the foregoing, it will be understood that the needle valve 2' in its opened state is not urged toward its seat by the intermediate piston 14', due to its larger relative total surface area, even when the same pressure prevails in the pressure chamber 4' and in the reservoir chamber 20. However, the situation is admittedly different when the fuel injection nozzle is closed, in which case the needle valve 2' would not lift from its seat with the above-cited and then prevalent surface equality. Even when the effective surface at the intermediate piston 14' is smaller than that of the working surface at the needle valve 2', the opening process possibly would be influenced disadvantageously by the intermediate piston 14'. For this reason, the valve 22 is installed in the line 21, by means of which valve 22 the correspondingly throttled pressure prevalent in the line 7' also establishes itself in the reservoir 20 only toward the end of the fuel injection operation. Once the pressure in the line 7', as well as that in the pressure chamber 4', falls, thereby terminating the fuel injection operation, the valve 22 retards any rapid pressure decrease in the reservoir 20, so that the piston 14' can correspondingly act upon the needle valve 2'. Since, as is well known, the pressure in the line 7' rises with an increase of the revolutions per unit time, it is advantageous that the pressure in the reservoir 20 also rises correspondingly. However, the cross-sectional area of the valve 22 can be varied by means of a slidable piston 23 to correlate the cross-sectional area to the pressure in the reservoir chamber 20.

Figure 2A:
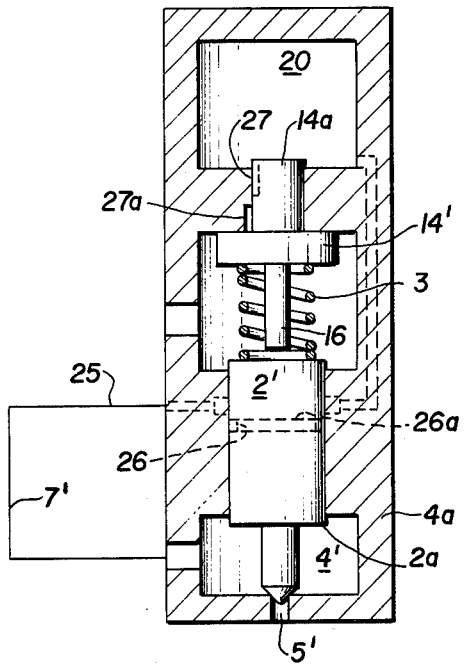
FIG. 2*a* is a further modified embodiment of the structure shown in FIG. 2.

An amplification of the force acting in the direction of closure against the needle valve 2' can, as represented by the dashed line in FIG. 2A, also be accomplished by connecting the pressure line 7' with the reservoir 20 via a channel 25 controlled by the needle valve 2'. This control takes place by means of the confronting annular groove 26 and the channel 25 which ends in the cylinder wall. It will be observed from FIG. 2A, that the aforesaid confronting grooves are at least in partial communication as soon as the needle valve 2' has nearly completed its opening stroke. The pressure from the line 7' thus becomes effective in the reservoir chamber 20 only after the needle valve 2' has already lifted from its seat, and the cross-sectional surface area of the valve is also being acted upon in an open direction. Moreover, the communication of the annular groove 26 and the channel 25 only becomes effective after the needle valve 2' has completed its opening stroke and as a result of the continuing movement of the needle valve 2' due to its moving mass. Once the pressure in the line 7' decreases for the final injection termination, the needle valve 2' is immediately displaced at which point the annular groove 26 and the channel 25 are separated from each other and the pressure established in the reservoir chamber 20 remains locked therein. This pressure diminishes during the fuel injection pauses due to leakage past the intermediate piston 14' to such an extent that the opening process of the needle valve 2' is not hindered. In order to control this leakage, longitudinal groove 27 is provided on the annular collar of portion 14*a* of the intermediate piston 14', and another groove 27*a* is provided on the interior surface of the cylinder 4*a* which houses the intermediate piston 14'. As shown, the longitudinal grooves 27, 27*a* are allowed to communicate only once the needle valve 2' is closed, and the intermediate piston 14' is displaced relative to the needle valve 2'.

In the embodiment shown in FIG. 2*a* the annular groove 26 which controls the channel 25 serves as a valve means. Thus, the valve needle 2' includes an annular channel 26 as a valve means which connects the chamber 20 with the compression chamber 4'.

FIG. 3 represents one preferred embodiment for the valve 22. A spool-like valve member 28 contains a throttle boring 29, via which boring connection is established between the line 21 and the reservoir chamber 20. This throttle boring 29 branches off from an annular groove 30 of the spool-like valve member 28 and leads to the end wall thereof, as shown. The annular groove 30 in turn communicates with an orifice 31 of the line 21 located in the cylinder which carries spool valve 28. As soon as a given predetermined pressure in the reservoir chamber 20 is exceeded, the valve 28 is displaced against a spring 32. In this manner, the cross-sectional area of the orifice 31 is decreased by the edge of the annular groove 30, i.e., the throttle 29, 31 becomes smaller as the pressure in the reservoir chamber 20 increases and vice versa. A supplementary influence upon the throttle control can be accomplished also by connecting the chamber 33 which contains the spring 32 with the line 7'. This would also produce the result that the orifice 31 is only closed or even throttled when the pressure in the line 7' decreases near termination of the fuel injection time point.

Figures 4, 5:
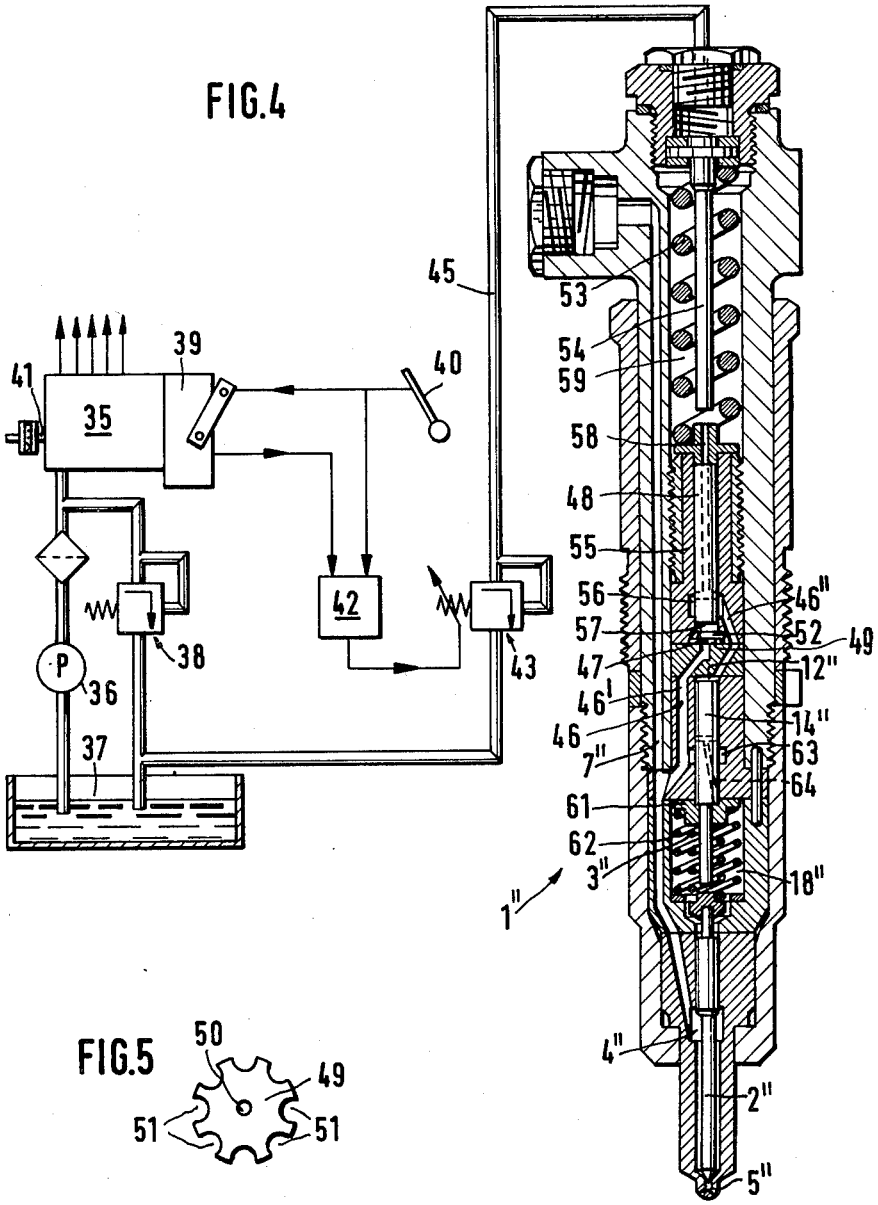
FIG. 4 is a cross-sectional view of another embodiment of a nozzle, schematically showing the system for the operation thereof.
FIG. 5 is a plan view of the disc element 49 included in the nozzle shown in FIG. 4.

FIG. 4 represents a system, according to the invention, in which amplification of the closure pressure is effected by means of spring storage. It is also illustrated in this view how the control of the opening pressure can also be accomplished by a simple means via the relief line. The fuel injection pump and the pressure control are depicted only schematically herein.

A fuel injection pump 35 is supplied with fuel by a customary pump 36 from a fuel container 37, at a determined pressure by a regulating valve 38. The fuel injection pump 35 is connected with an injection quantity regulator 39, from which the engine characteristics of the revolutions per unit time and of the load are obtainable. The regulator 39 receives the data on the load by means of the given position of the accelerator pedal 40, and on the revolutions per unit time by means of the drive shaft 41. The revolutions per unit time and the load are further converted by a converter 42 into a positioning value which is fed to a pressure control valve 43, so that the pressure determined by this valve varies in accordance with the revolutions per unit time and with the load. The converter 42 can be included in the regulator 30, for example, in the form of the regulator itself, so that the positioning value for the pressure control valve 43 is the positioning value of the regulator rod for the fuel apportionment of the fuel injection pump. It is also conceivable that the pressure control valve 43 can be accommodated within the fuel injection pump regulator module 35, 39.

In this exemplary embodiment, the pressure in the spring chamber 18'' of the fuel injection nozzle 1'' is governed by means of the pressure control valve 43, which is situated in the relief line 45 of the spring chamber. In the injection nozzle 1'', a line 46 branches off the pressure line 7'' leading to the pressure chamber 4'' of the nozzle, this line 46 being controlled by a throttle valve 47 which includes a control plunger 48 that leads to the pressure chamber 12'' above the intermediate piston 14''. The throttle valve 47 exhibits a differing throttle effect according to the given flow direction of the fuel in the channel 46. For this purpose, the throttle valve 47 is constructed as a disk valve. As shown in FIG. 5, the disk 49 of the valve 47 has an axial throttle boring 50 which is surrounded by a plurality of recesses 51 provided in the rim as shown. This disk 49 is axially displaceable within a chamber 52, whose end faces serve in part as the valve seats of the throttle valve 47. When the fuel stream travels in from the pressure line 7'' to the control plunger 48 and thence to the pressure chamber 12'', the fuel can flow via the boring 50 as well as via the recesses 51, whereas when the fuel stream flows in a reverse, the recesses 51 are blocked by the valve seat, so that fuel can then flow solely through the throttle boring 50. Thus, the throttling effect of fuel flow in this latter direction is substantially greater than would be the flow of fuel in the opposite direction. The control plunger 48 is acted upon by the load of a storage spring 53, and its path of travel is limited by a projection 54. The line 46 is divided into two flow lines 46' and 46'' by means of the control plunger 48. To control these connections between the flow lines an annular groove 56 is provided in the cylinder in which the control plunger is arranged to operate with the annular groove 56 being opened by means of the lower face end 57 of the control plunger after a partial completion of the storage stroke. In addition, the annular groove 56 cooperates with the boring 58 provided in the control plunger 48, this boring 58 being relieved in the direction toward the spring chamber 59 of the storage element and arranged to communicate with the annular groove 56 in the depicted rest position of the control plunger 48, as shown, whereas the boring 58 is moved out of contact with the annular groove 56 after the start of the storage stroke.

The spring chamber 18'' of the fuel injection nozzle 1'', which contains the closure spring 3'' of the needle valve 2'', communicates with the spring chamber 59 via a channel (not shown) so that essentially the same pressure prevails in both chambers. The closure spring 3'' of the needle valve 2'' is urged upwardly together with the spring disk 61 against the intermediate piston 14''. A spring 62 disposed within the spring chamber 18'' additionally serves as the return spring for the intermediate piston 14'' and is supported by the opposite face of the spring chamber 18''. By this means, the total spring force which acts on the intermediate piston 14'' is substantially greater than the spring force acting against the needle valve 2'' in the direction of closure. Other combinations for the accommodation of the injection program are, of course, also conceivable, for example two springs could act on the needle valve 2'' and only one on the intermediate piston 14'', or only a single spring could be employed between the two components. Corresponding to the given strength and number, as well as the given arrangement of the springs and corresponding to the given effective surfaces of the components impinged upon by the fuel, i.e., their cross-sectional areas, differing influences on the fuel injection program can be achieved. An annular groove 63 is located within the cylinder surrounding the intermediate piston 14'', which annular groove 63 communicates with the pressure line 7'' and is also arranged to cooperate with the boring 64 located in the intermediate piston 14'', which boring 64 leads to the spring chamber 18''. The annular groove 63 is adapted to connect with the boring 64 when the intermediate piston 14'' acts directly on the needle valve 2'' and has closed the fuel injection valve.

The method of operation of the fuel injection valve is as follows; As soon as fuel is delivered to the pressure chamber 4'' of the fuel injection nozzle 1'' from the fuel injection pump 35 via the pressure line 7'', the needle valve 2'' lifts off its seat in opposition to the force of the closure spring 3''. Fuel flows simultaneously via the line section 46' and the throttle valve 47 via its recesses 51 (FIG. 5) as well as the throttle boring 50 and under the control plunger 48, which is thereby displaced in opposition to the storage spring 53. After the completion of a predetermined stroke length, the annular groove 56 is opened by means of the surface 57 of the control plunger 28, which annular groove 56 then interconnects the line channel section 46' with the section 46'', so that the pressurized fuel can reach the pressure chamber 12''. Thereafter, in a case of overload, the control plunger 48 is displaced further up to a projection 54. As soon as the pressure in the line 7'' decreases for the fuel injection termination, the needle valve 2'', too, is pushed onto its seat by means of the spring 3'', and the control plunger 48 is simultaneously displaced downward by means of the storage spring 53 to transport the fuel stored ahead of it into the pressure chamber 12'' via the channel section 46'', so that the intermediate piston 14'' is displaced in the direction toward the needle valve 2'' (piston continuously in contact with needle). This is now possible, since the resultant force primarily acts in closing direction of the valve needle and the intermediate piston 14''. As soon as the boring 64 in the intermediate piston 14'' comes into alignment with the annular groove 63 the pressure in the chamber 4'' of the fuel injection nozzle is relieved toward the spring chamber 18'', which action further increases the forces which act on the needle valve 2'' in the direction of its closure. The forces which act through the control plunger 48 in the direction of closure maintain their effect until the surface 57 moves away from the annular groove 56, all of which is determined by the cross-sectional area of the boring 50. Shortly thereafter, the line section 46'' is then relieved toward the spring chamber 59 via the boring 58 which is provided within the apportioning piston 48.

The magnitude of the pressure at which this relief takes place can, in a given case, be determined by means of the pressure control valve 43 that is arranged in the relief line 45. By means of this supplementary pressure control in the pressure chamber 12'' as well as in the spring chamber 18'', the injection program can be influenced in a desirable manner, although preferably in the form of a structuring of the fuel injection process by means of the control of the opening stroke of the needle valve 2''.

Figures 6, 7:
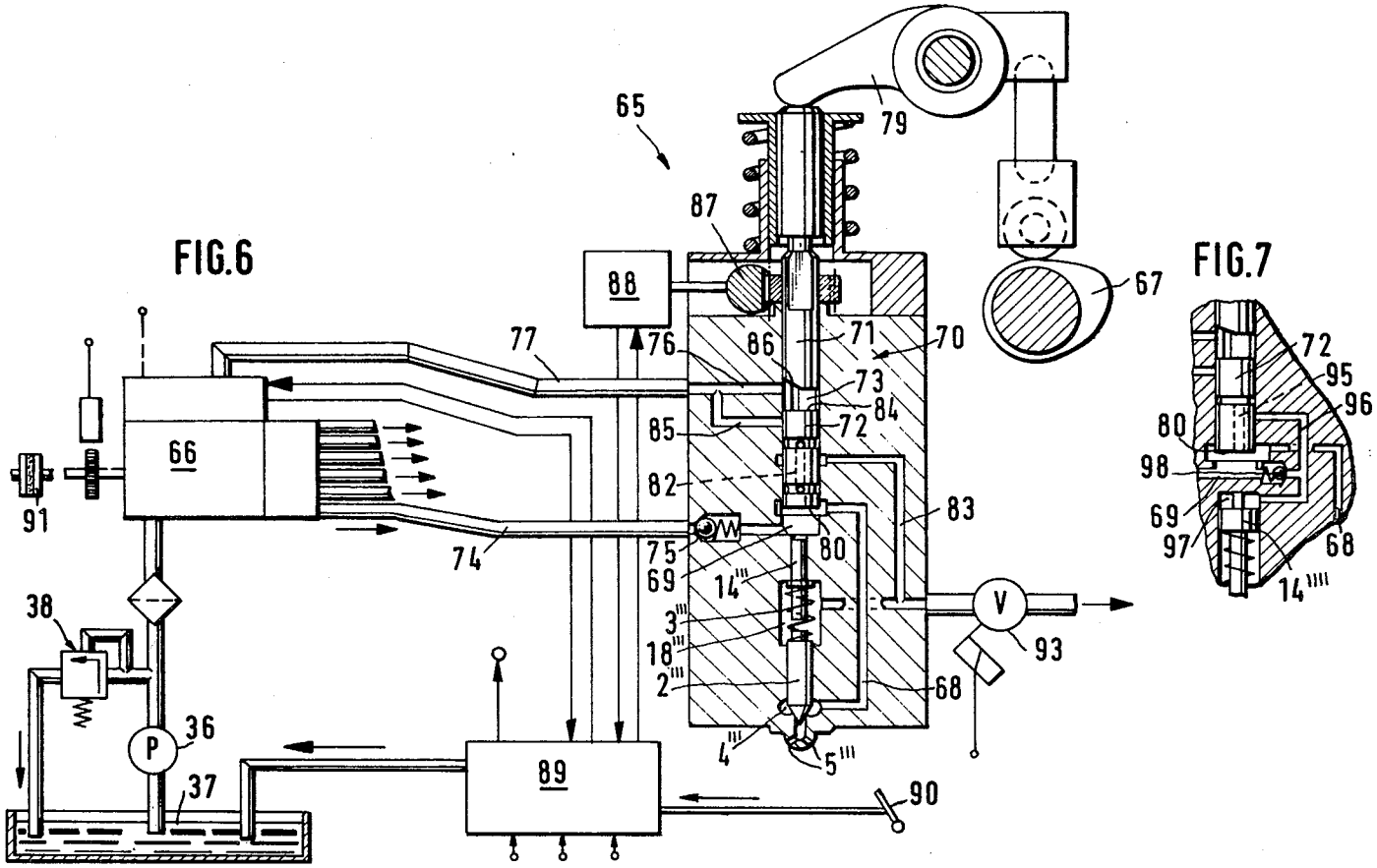
FIG. 6 shows a schematic view of still another embodiment of the invention including another type of nozzle having a slave piston and its system of operation.
FIG. 7 is an enlarged schematic view of the slave piston and its operation.

FIGS. 6 and 7 depict a pump nozzle generally at 65, this nozzle being supplied with fuel from a fuel injection pump 66 which is driven by means of camshaft 67. For the sake of simplicity, the parts which correspond to those of the previously described fuel injection nozzles are provided with similar reference numerals. The closure spring 3''' disposed in the spring chamber 18''' simultaneously thrusts against the needle valve 2''' and the intermediate piston 14'''. The pressure chamber 4''' of the nozzle is supplied with fuel from a pump chamber 69 during the pressure stroke of the pump piston generally indicated as 70, via a pressure line 68. The pump piston 70 includes a directly driven transport piston 71 and a slave piston 72. Between the transport piston and the slave piston there is provided a chamber 73 filled with fuel, which chamber 73 can be viewed as being a part of the pump piston 70.

The given quantity of fuel to be injected is determined by the injection pump 66, which pre-loads its predetermined quantity into the pump chamber 69 via one of its pressure lines 74 which contains a check valve 75. Corresponding to the given pre-loaded quantity of fuel the slave piston 72 will move in the direction of the transport piston 71. This movement takes place during the suction stroke of the pump nozzle during which time the transport piston 71 also executes a corresponding movement. In its extreme upper position, the lower surface edge of transport piston 71 opens a boring 76 which leads to a chamber of a lower pressure, in this instance to the suction chamber of the injection pump 66 via the line 77. A variation in the quantity of fuel pre-loaded into the pump chamber 69, as shown in the drawing, results in a corresponding variation of the volume of the chamber 73, i.e., fuel flows in or out via the boring 76.

During the transport stroke of the pump nozzle 65 the transport piston 71 is moved in a direction toward the slave piston 72 by means of the cam 67 and the rocker lever 70, whereby fuel is made to flow from the chamber 73 via the boring 76 until such time as the boring 76 is closed. Subsequent thereto, the slave piston 72 is displaced by means of the enclosed volume of the chamber 73, and the slave piston then, in turn, expels the fuel to be injected from the pump chamber 69 via the pressure line 68 into the pressure chamber 4''' of the nozzle and from which the fuel then reaches the engine via the fuel injection openings 5''' as soon as the needle valve 2''' is lifted. Fuel injection termination is brought about by the lower surface 80 (FIG. 7) of the slave piston closing the pressure line 68. The fuel expelled from the pump working chamber 69 during the further continuation of the transport stroke of the pump piston 70 acts upon the intermediate piston 14''' and pushes it in opposition to the force of the closure spring 3''' against the needle valve 2'''. In this manner, an extraordinarily high closure pressure is created. Along with the closure of the pressure line 68 by the slave piston 72, the pressure line 68 is thereby connected to a relief line 83 by means of the spaced annular grooves and boring 82 provided in the slave piston 72. The pressure in chamber 4''' of the nozzle is herewith correspondingly decreased, in order to obtain a sharp closure termination. Toward the end of the transport stroke of the slave piston 72, the upper surface 84 of the slave piston opens a boring 85, which is connected to the line 77. Hence, the transport piston 71 can continue its full supplying stroke and fuel flows from the chamber 73 via the boring 85 during which the slave piston remains in a closed position. Only when the pump piston 70 begins its return stroke that is controlled by the cam 67, can the intermediate piston 14''' also glide back to its initial position. However, this time point will always be chosen in such a way that it will be impossible to press the needle valve 2''' open from either the engine chamber or the pressure chamber 4'''.

In order to obtain a possibly necessary fuel injection time point adjustment, the transport piston 71 which has a beveled area 86 is rotatable by means of an apparatus, for example by means of a gear rack 87. This adjustment permits the boring 76 to be closed at different times according to the given rotational position of the transport piston 71, so that the impulsion of the slave piston 72 takes place at any desired time point. The adjustment of the apparatus 87 can take place by means of a positioning motor 88, which may be controlled by an electronic control device 89. Also, the control device 89 can simultaneously serve for the regulation of the fuel injection pump 66 or can comprise the pump regulator. The load data would thus be fed to this control device 89 via the accelerator pedal 90, whereas data on the revolutions per unit time is directly fed to the fuel injection pump 66 via its coupling 90. A supplementary control of the fuel injection program can take place by means of a check valve 93, which is installed in the relief line 83, and via which the pressure in the spring chamber 18''', and therewith the opening stroke of the needle valve 2''', are controlled. The pressure control valve 93 can likewise be controlled by means of the control device 89.

FIG. 7 shows a further embodiment for impulsion of the intermediate piston 14''''. The intermediate piston 14'''' in this construction is not acted upon directly by the pressure prevailing in the pump working chamber 69, but rather only after a corresponding controlling action by the slave piston 72. As soon as the lower surface 80 of the slave piston 72 has blocked the pressure line 68 for the termination of fuel injection, a line 96 is opened via bore 95, which line 96 leads to a pressure chamber 97 of the intermediate piston 14''''. Hence, only after this opening action of the channel 96 is the intermediate piston 14'''' displaced in a direction toward the needle valve. This achieves the result that the intermediate piston is not acted upon by the pressure in the pump working chamber 69 prior to the termination of the fuel injection stroke. The relief of pressure in chamber 97 takes place via a check valve 98 or via corresponding channel controls which include the slave piston 72. Thus, the principal object of the invention, namely to obtain an amplification of the closure pressure of the needle valve by means of an intermediate piston which acts against the needle valve with an increased pressure after the fuel injection operation is determined, can naturally also be implemented with a pump nozzle which does not possess a slave piston, but rather transports fuel directly by means of a driven pump piston, or with a pump nozzle whose pump piston is impelled by means of a servo piston having a larger cross-sectional area via which the pressure elevation is produced. The intermediate piston can, according to the invention, also serve to define the injection program during the opening stroke. It is a decisive feature of the invention that the injection termination is followed by the aforementioned amplification of the closure pressure.

What is claimed is:

1. A fuel injection nozzle having a bored body, axially spaced chambers in said body, a fuel supply inlet and a fuel discharge outlet, a fluid pressure operated needle valve extending into one chamber and a closure spring for said needle valve in another of said chambers arranged to cooperate with said needle valve, wherein the improvement comprises an hydraulically actuated intermediate piston including upper and lower working surfaces one of which is subjected to pressure in the spring chamber and another of which is subjected to fluid pressure in the chamber provided immediately above said spring chamber, and said fluid pressure chamber being connected to a line leading to a pump whereby closing pressure on the needle valve may be increased in a controlled manner.

2. A fuel injection nozzle according to claim 1, in which a clearance at least equal to the size of the opening stroke of the needle valve is provided between said needle valve and said intermediate piston.

3. A fuel injection nozzle according to claim 1, in which said intermediate piston includes a surface against which said spring is thrust in opposition to said needle valve.

4. A fuel injection nozzle according to claim 1, in which said bored body includes an internal annular shelf area, plural spring means disposed on opposite sides of said shelf area one each of said springs engaging said intermediate piston and said needle valve.

5. A fuel injection nozzle according to claim 1, in which fuel is fed from synchronously driven pumps through separate lines to the chamber in which the needle valve is operatively disposed as well as to the chamber in which the upper working surface of the intermediate piston is disposed.

6. A fuel injection nozzle according to claim 5, in which said synchronously driven pumps are associated with a fuel injection time adjusting means.

7. A fuel injection nozzle according to claim 1, in which the chamber in which said needle valve is disposed and said chamber in which the upper working surface of said intermediate piston is disposed are connected by a fuel line including valving means.

8. A fuel injection nozzle according to claim 7, in which said valving means includes pressure equalizing means.

9. A fuel injection nozzle according to claim 8, in which the pressure equalizing means is operated in accordance with the pressure prevailing in the chamber in which the upper working surface of said intermediate piston is disposed.

10. A fuel injection nozzle according to claim 7, in which the needle valve includes an annular channel that communicates with a line leading to said fuel line containing the valving means.

11. A fuel injection nozzle according to claim 7, in which said upper working surface of said intermediate piston is in fluid communication with control plunger means.

12. A fuel injection nozzle according to claim 11, in which said control plunger means cooperates with a flexible means.

13. A fuel injection nozzle according to claim 12, in which said control plunger means cooperates with throttle valve means which are in communication with lines extending to said chamber which subjects the upper working surface of said intermediate piston to pressure.

14. A fuel injection nozzle according to claim 13, in which said chamber immediately above said spring chamber is connected to said last named chamber by said control plunger means.

15. A fuel injection nozzle according to claim 1, in which the fuel injection nozzle further includes a cylinder having a transport piston and an associated working chamber arranged to be filled by check valve means.

16. A fuel injection nozzle according to claim 15, in which said working chamber is connected to a further pressure chamber that is associated with said transport piston.

17. A fuel injection nozzle according to claim 15, in which the chamber in which said needle valve is contained is connected with said spring chamber as well as to said transport piston by a suitable line.

18. A fuel injection nozzle according to claim 15, in which said transport piston is driven by a cam means.

19. A fuel injection nozzle according to claim 18, in which said transport piston cooperates with a slave piston, said slave piston being arranged to control said line leading to said needle valve chamber.

20. A fuel injection nozzle according to claim 19, in which said transport piston is rotatable about its longitudinal extent in said cylinder.

21. A fuel injection nozzle according to claim 20, in which said piston includes a chamfered terminal portion serving to control fluid flow in a line extending to said injection pump.

* * * * *